US007233298B2

(12) United States Patent
Nagel et al.

(10) Patent No.: US 7,233,298 B2
(45) Date of Patent: Jun. 19, 2007

(54) HIGH PERFORMANCE ANTENNA

(75) Inventors: Jon L. Nagel, San Jose, CA (US); Jeffrey Nagel, San Jose, CA (US)

(73) Assignee: Wavetest Systems, Inc.

( * ) Notice: Subject to any disclaimer, the term of this patent is extended or adjusted under 35 U.S.C. 154(b) by 0 days.

(21) Appl. No.: 10/697,338

(22) Filed: Oct. 30, 2003

(65) Prior Publication Data

US 2005/0093765 A1 May 5, 2005

(51) Int. Cl.
*H01Q 1/36* (2006.01)

(52) U.S. Cl. ..... 343/895; 343/702

(58) Field of Classification Search ..... 343/718, 343/722, 793, 795, 802, 803, 806, 878, 895, 343/713, 702, 700
See application file for complete search history.

(56) References Cited

U.S. PATENT DOCUMENTS 4,788,550 A * 11/1988 Chadima, Jr. ..... 343/712
5,134,422 A * 7/1992 Auriol ..... 343/895
5,754,143 A * 5/1998 Warnagiris et al. ..... 343/767
5,767,808 A * 6/1998 Robbins et al. ..... 343/700 MS
5,986,616 A * 11/1999 Edvardsson ..... 343/853
6,061,025 A * 5/2000 Jackson et al. ..... 343/700 MS
6,069,592 A * 5/2000 Wass ..... 343/895
6,107,967 A * 8/2000 Hill ..... 343/702
6,181,290 B1 * 1/2001 Zaitsev et al. ..... 343/786
6,246,371 B1 * 6/2001 Kurz et al. ..... 343/702
6,317,094 B1 * 11/2001 Wu et al. ..... 343/767
6,404,394 B1 * 6/2002 Hill ..... 343/702
6,417,816 B2 * 7/2002 Sadler et al. ..... 343/795
6,642,893 B1 * 11/2003 Hebron et al. ..... 343/702
6,650,302 B2 * 11/2003 Sanad ..... 343/841
6,677,905 B2 * 1/2004 Deguchi et al. ..... 343/702
6,753,816 B1 * 6/2004 Apostolos ..... 343/700 MS
6,806,831 B2 * 10/2004 Johansson et al. ... 343/700 MS
2002/0075188 A1 * 6/2002 Wu ..... 343/702
2003/0071757 A1 * 4/2003 Yamaki ..... 343/741
2003/0210188 A1 * 11/2003 Hebron et al. ..... 343/700 MS
2004/0051672 A1 * 3/2004 Nevermann et al. ..... 343/702
2005/0057418 A1 * 3/2005 Knadle et al. ..... 343/815

FOREIGN PATENT DOCUMENTS

RU 2 205 478 * 5/2003

* cited by examiner

*Primary Examiner*—Tho Phan
(74) *Attorney, Agent, or Firm*—Ethan D. Civan

(57) ABSTRACT

An antenna including a planar conductor, in which the planar conductor is self-supporting and the radiating pattern of the antenna is substantially isotropic.

25 Claims, 12 Drawing Sheets

HIGH PERFORMANCE ANTENNA

FIELD OF THE INVENTION

The present invention relates to radio frequency antennas.

BACKGROUND

Monopole antennas are commonly used in radio antenna design for mobile applications. A monopole antenna has a single radiating element. The simplest monopole antenna is the quarter-wave isotropic antenna. It comprises two elements, the first being a conductive radiating element that is usually a round structure and has an electrical length of ¼ wavelength. The second element is a ground plane element.

Quarter-wave antennas are excellent performing antennas and are the smallest resonating structures that are used when the radiating structure is straight. Unfortunately, the radiating structure length in radio frequency (hereinafter "RF") bands now used in wireless communications can be prohibitively long for low profile enclosures. For example, the radiating element for a quarter-wave antenna operating at 2.4 Gigahertz (hereinafter "GHz") to 2.5 GHz would be about 1.1 inches in length.

Vertically polarized antennas are often used in mobile applications, either as the portable terminal or the base station. However, currently available vertically polarized antennas such as the quarter-wave antenna, are often too large for current applications, where compactness is extremely important. For example, in a personal digital assistant, an extremely small antenna is particularly desirable.

Horizontally polarized antennas may be very low profile when antennas are etched on a radio personal computer (hereinafter "P.C.") board (such as a PCMCIA or Compact Flash card), but suffer from attenuated performance in mobile applications due to incorrect polarity for most applications. Single and dual element (quarter-wave and dipole) horizontally polarized antennas have deep signal nulls around the antennas, even when the units being communicated with use the same polarization. Most mobile applications use vertically polarized antennas (monopoles) to eliminate nulls around the antennas.

What are needed are antennas to overcome the problems described above.

SUMMARY OF THE INVENTION

An antenna including a planar conductor, in which the planar conductor is self-supporting and the radiating pattern of the antenna is substantially isotropic.

DETAILED DESCRIPTION OF THE PREFERRED EMBODIMENTS

Figure 1A:
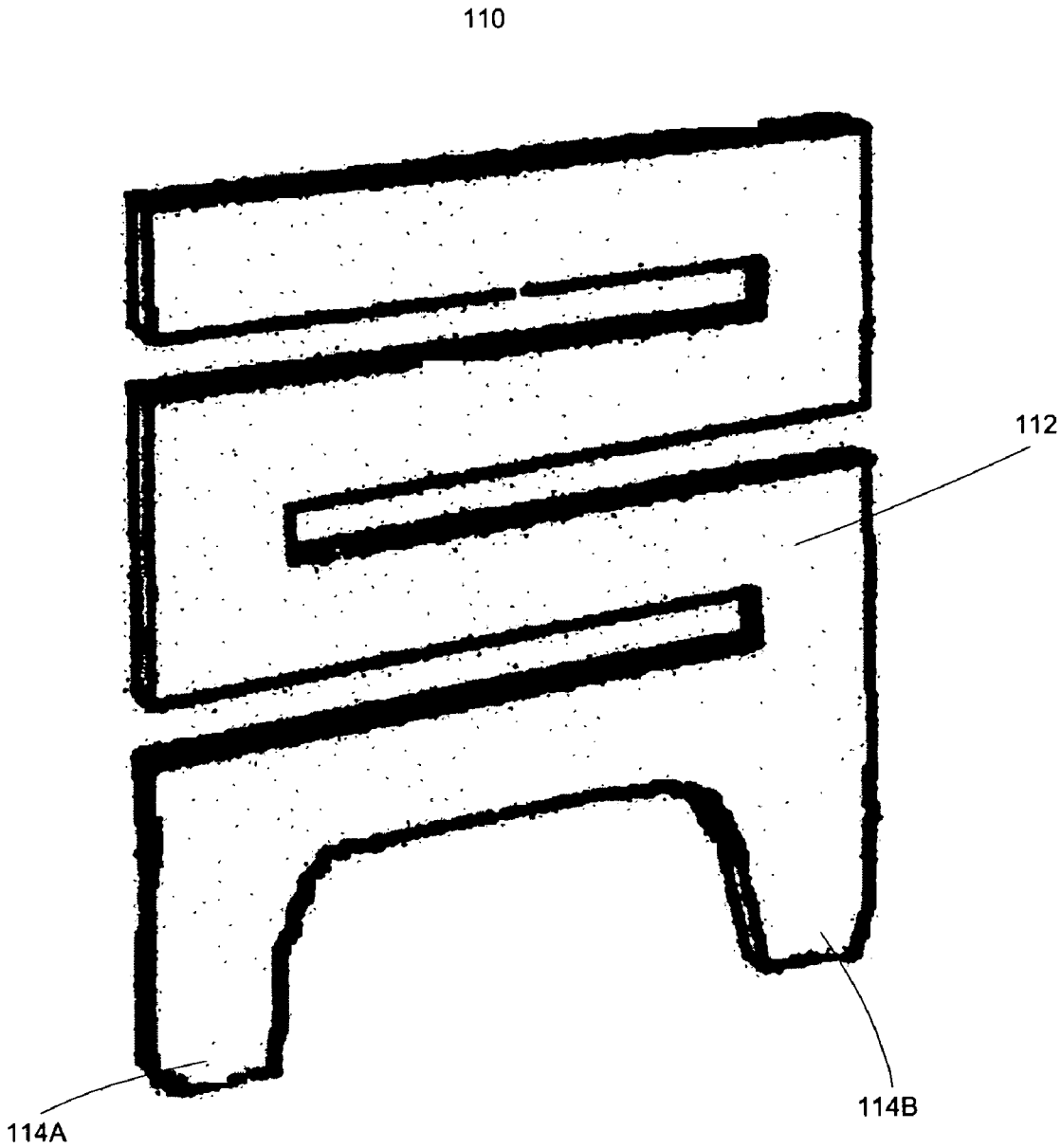
FIG. 1A is a front view of a first antenna in accordance with a first embodiment of the present invention.

Referring to FIG. 1A, a first embodiment of the present invention is illustrated (hereinafter the "Meander Embodiment"). A self-supporting antenna 110 in the form of a planar meander 112 is illustrated. The antenna in a first embodiment is composed completely of conductive material; in an alternate embodiment, it includes only a small amount of dielectric material that has no significant effect on the antenna's radio frequency properties. In a first embodiment, the antenna is malleable, although in certain embodiments of the present invention, the antenna is not malleable.

While FIG. 1A illustrates one particular planar meander, the present invention is not confined to the illustrated planar meander, but instead encompasses all planar meanders. For example, the planar meander can be taller or shorter, wider or narrower, thicker or thinner, sit closer to or further from the P.C. board, and have larger or smaller gaps within it. One important factor affecting the radio frequency properties of the antenna is the volume of conductor used in the meander. Several dimensions can be adjusted simultaneously to provide a meander of equivalent volume. Furthermore, antennas intended for use on different radio frequency bands require different radio frequency properties. Thus, other antennas in accordance with the present invention can be taller, thicker, wider, thinner, shorter, etc. Of course, other factors also affect the radio frequency properties of an antenna; hence, adjusting the volume of the meander is not the only method of altering the antenna's properties.

Figure 1B:
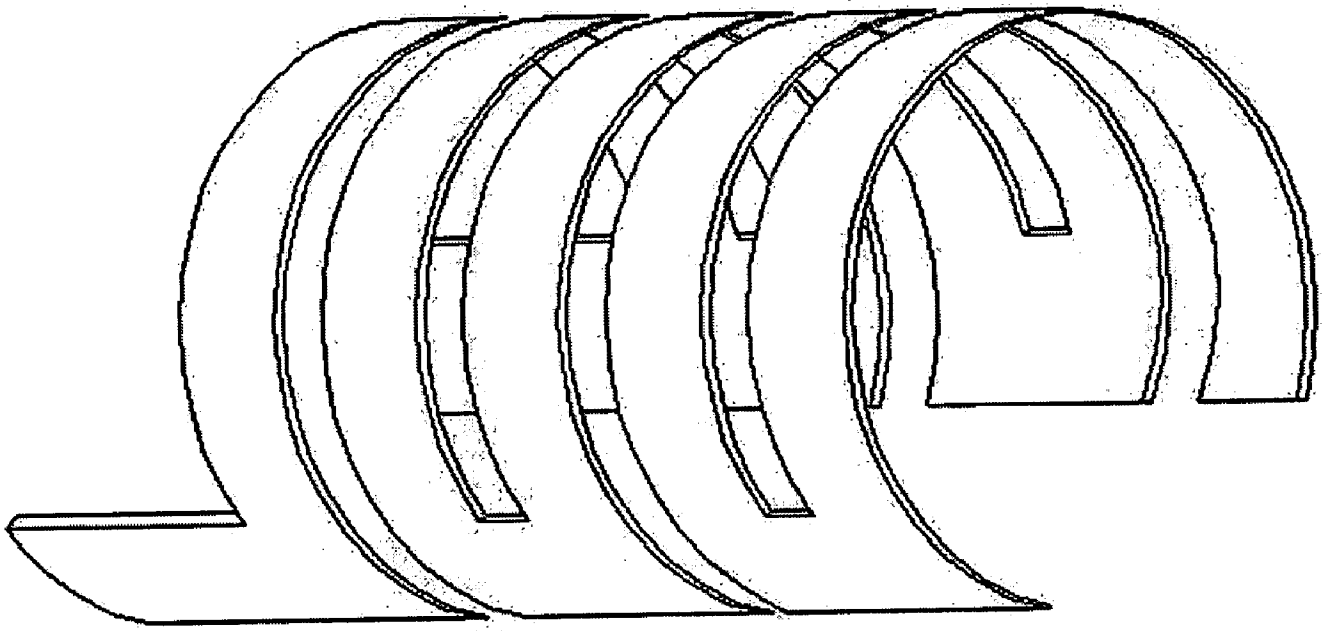
FIG. 1B is a view of a second antenna in accordance with a first embodiment of the present invention.

Moreover, the meander need not be formed in the general shape of a planar rectangle, but can be formed of a wide variety of shapes. FIG. 1B illustrates a curved meander in the form of a partially open cylindrical shape that has satisfactory radio frequency properties. Other shapes, depending on the application for which a particular antenna is intended, the radio frequency properties required, the materials used, and other factors, are also possible.

The antenna can be made of tin or nickel plated steel, with the steel being fifteen-thousandths of an inch in thickness and the tin or nickel coating being between one and four ten-thousandths of an inch in thickness. A gold plating of between one and four ten-thousandths of an inch in thickness can optionally be used over the tin or nickel plating as well. In many embodiments, steel comprises at least ninety-seven percent by weight of the antenna. Other conductors and other thicknesses can be used as well. The lack of dielectric material (or of significant dielectric material) provides several advantages. First, greater frequency stability is provided compared to conventional antennas. Changes in dielectric constants of dielectric materials used (due to manufacturing variation or environmental factors) cause frequency shifts and loss of signals due to the loss tangent of materials, especially at high frequencies. Second, the (relative or total) absence of dielectric materials contributes to less signal attenuation due to radio energy absorption by the dielectric materials. For example, normal materials used to support metal antennas such as P.C. board material will reduce radiating energy because the P.C. board will absorb energy from the etched copper on the P.C. board surface. This produces a less efficient antenna. Third, the (relative or total) lack of dielectric materials results in substantial manufacturing savings, both because conductive materials that cost less than dielectric materials can be used and because the conductive materials can be manipulated inexpensively in the production process.

In certain embodiments of the present invention (hereinafter the "ESD Embodiments"), integral electrostatic discharge (hereinafter "ESD") protection is provided through the use of a shunt, or autotransformer matching, which provides a ground from the antenna structure that protects the antenna port on the radio from ESD. The shunt is a tapped inductor that is used for impedance transformation. In this case, the shunt provides integral protection for ESD because one tap or leg is grounded. The other tap is located at another point along the antenna trace, preferably at a 50 Ohm feed point. The ESD Embodiments can therefore protect the radio antenna ports. These embodiments reduce costs in radio manufacturing by eliminating the need to utilize additional parts on the radio board and also save space on the radio board, allowing the devices in which the antennas are mounted to be made smaller, which is a significant advantage in the case of a mobile device.

Referring again to FIG. 1A, legs 114A and 114B can optionally be used to provide such integral ESD protection. For example, leg 114A can be grounded and leg 114B can be located at the 50 Ohm feed point. Alternatively, legs 114A and 114B can be used to attach the antenna to a P.C. board without providing integral ESD protection. In other embodiments of the present invention, different numbers, sizes, or shapes of legs can be used. For example, in embodiments without integral ESD protection, a single leg can be used, while in any embodiment more than two legs can be used, e.g., to confer greater mechanical and radio frequency stability on the antenna. Of course, altering the number of legs (or the size or shape of legs) can alter the radio frequency properties of the antenna and other portions of the antenna can also need to be altered to compensate for such changes.

Figure 2:
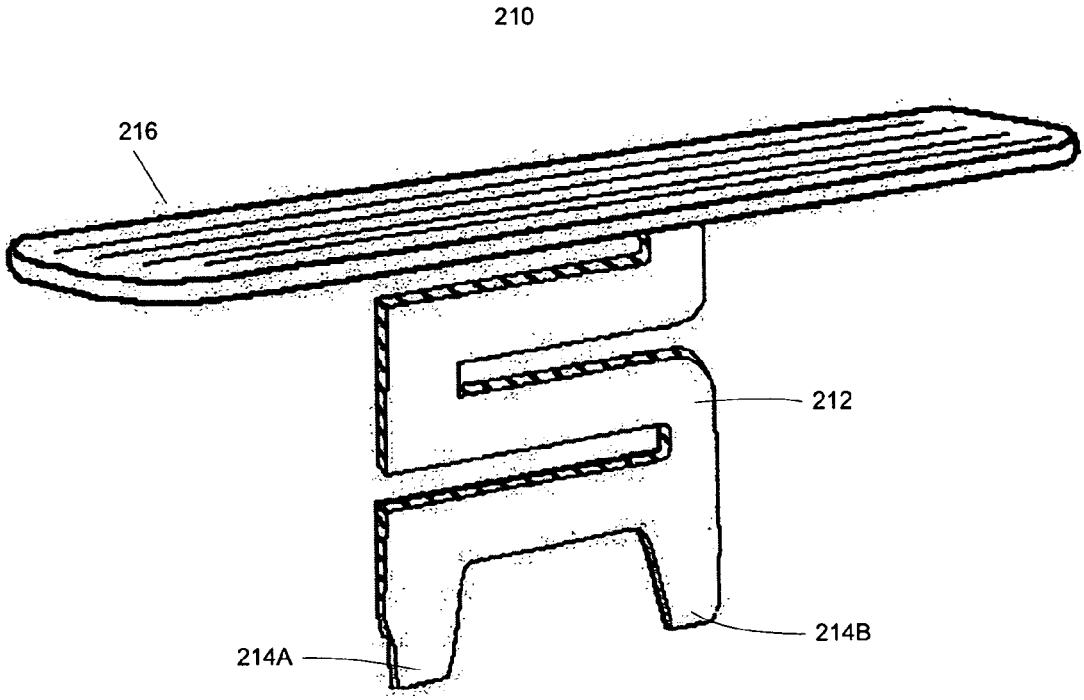
FIG. 2 is a view of an antenna in accordance with a second embodiment of the present invention.

Referring to FIG. 2, a second embodiment of the present invention (hereinafter the "Combination Embodiment") is illustrated. A self-supporting antenna 210 in the form of a planar meander 212 attached to a secondary planar conductor 216 is illustrated. The antenna in a first embodiment is composed completely of conductive material; in an alternate embodiment, it includes only a small amount of dielectric material that has no significant effect on the antenna's radio frequency properties. In a first embodiment, the antenna is malleable, although in certain embodiments of the present invention, the antenna is not malleable.

While FIG. 2 illustrates one particular planar meander, the present invention is not confined to the illustrated planar meander, but instead encompasses all planar meanders. For example, the planar meander can be taller or shorter, wider or narrower, thicker or thinner, sit closer to or further from the P.C. board, and have larger or smaller gaps within it. One important factor affecting the radio frequency properties of the antenna is the volume of conductor used in the meander. Several dimensions can be adjusted simultaneously to provide a meander of equivalent volume. Furthermore, antennas intended for use on different bands require different radio frequency properties. Thus, other antennas in accordance with the present invention can be taller, thicker, wider, thinner, shorter, etc. Of course, other factors also affect the radio frequency properties of an antenna; hence, adjusting the volume of the meander is not the only method of altering the antenna's properties.

FIG. 2 illustrates an obround, or racetrack shaped, secondary planar conductor 216. While this shape has been found to have desirable radio frequency properties, the present invention encompasses other shapes as well and, in other embodiments, other shapes may be found to be more efficacious. In certain embodiments of the present invention, planar meander 212 is connected to secondary planar conductor 216 in the center of its length. If one end of secondary planar conductor 216 is connected to planar meander 212, the antenna will lose gain in the polarization direction of planar meander 212. The added element then becomes an element that picks up signal at the opposite polarity. Cross polarization is improved but for most applications the entire signal is wanted in the polarization used.

The antenna can be made of tin or nickel plated steel, with the steel being fifteen-thousandths of an inch in thickness and the tin or nickel coating being between one and four ten-thousandths of an inch in thickness. A gold plating of between one and four ten-thousandths of an inch in thickness can optionally be used over the tin or nickel plating as well. In other embodiments, greater thicknesses of steel can be used. For example, for a low profile antenna for 915 Megahertz military use that is two and a half inches in height, a thickness of twenty to twenty-five thousandths of an inch of steel can be used to avoid excessive flexing of the antenna. In other embodiments, greater or lesser thicknesses can be used, with the only limiting factors being the requirements of the specific application and the effects on the antenna's radio frequency and other properties of the increased or decreased thickness.

In many embodiments, steel comprises at least ninety-seven percent by weight of the antenna. Other conductors and other thicknesses can be used as well. The lack of dielectric material (or of significant dielectric material) provides several advantages. First, greater frequency stability is provided compared to conventional antennas. Changes in dielectric constants of dielectric materials used (due to manufacturing variation or environmental factors) cause frequency shifts and loss of signals due to the loss tangent of materials, especially at high frequencies. Second, the (relative or total) absence of dielectric materials contributes to less signal attenuation due to radio energy absorption by the dielectric materials. For example, normal materials used to support metal antennas such as P.C. board material will produce less radiating energy because the P.C. board will absorb energy from the etched copper on the P.C. board surface. This produces a less efficient antenna. Third, the (relative or total) lack of dielectric materials results in substantial manufacturing savings, both because conductive materials that cost less than dielectric materials can be used and because the conductive materials can be manipulated inexpensively in the production process.

In certain embodiments of the present invention (hereinafter the "ESD Embodiments"), integral electrostatic discharge (hereinafter "ESD") protection is provided through the use of a shunt, or autotransformer matching, which provides a ground from the antenna structure that protects the antenna port on the radio from ESD. The shunt is a tapped inductor that is used for impedance transformation. In this case, the shunt provides integral protection for ESD because one tap or leg is grounded. The other tap is located at another point along the antenna trace, preferably at a 50 Ohm feed point. The ESD Embodiments can therefore protect the radio antenna ports. These embodiments reduce costs in radio manufacturing by eliminating the need to utilize additional parts on the radio board and also save space on the radio board, allowing the devices in which the antennas are mounted to be made smaller, which is a significant advantage in the case of a mobile device.

Referring again to FIG. 2, legs 214A and 214B can optionally be used to provide such integral ESD protection. For example, leg 214A can be grounded and leg 214B can be located at the 50 Ohm feed point. Alternatively, legs 214A and 214B can be used to attach the antenna to a P.C. board without providing integral ESD protection. In other embodiments of the present invention, different numbers, sizes, or shapes of legs can be used. For example, in embodiments without integral ESD protection, a single leg can be used, while in any embodiment more than two legs can be used, e.g., to confer greater stability on the antenna. Of course, altering the number of legs (or the size or shape of legs) can alter the radio frequency properties of the antenna and other portions of the antenna can also need to be altered to compensate for such changes.

Figure 3A:
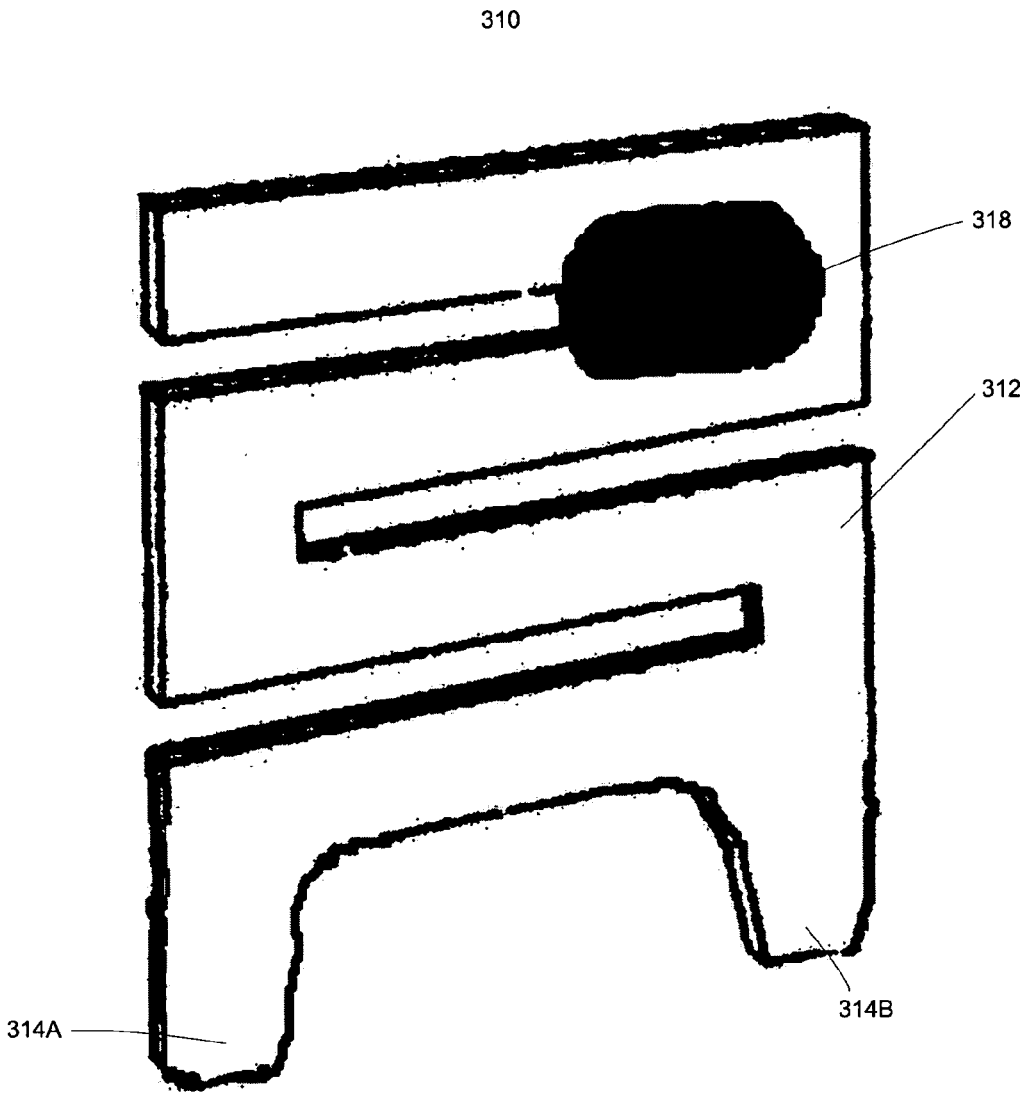
FIG. 3A is a front view of a first antenna in accordance with a third embodiment of the present invention.
Figure 3B:
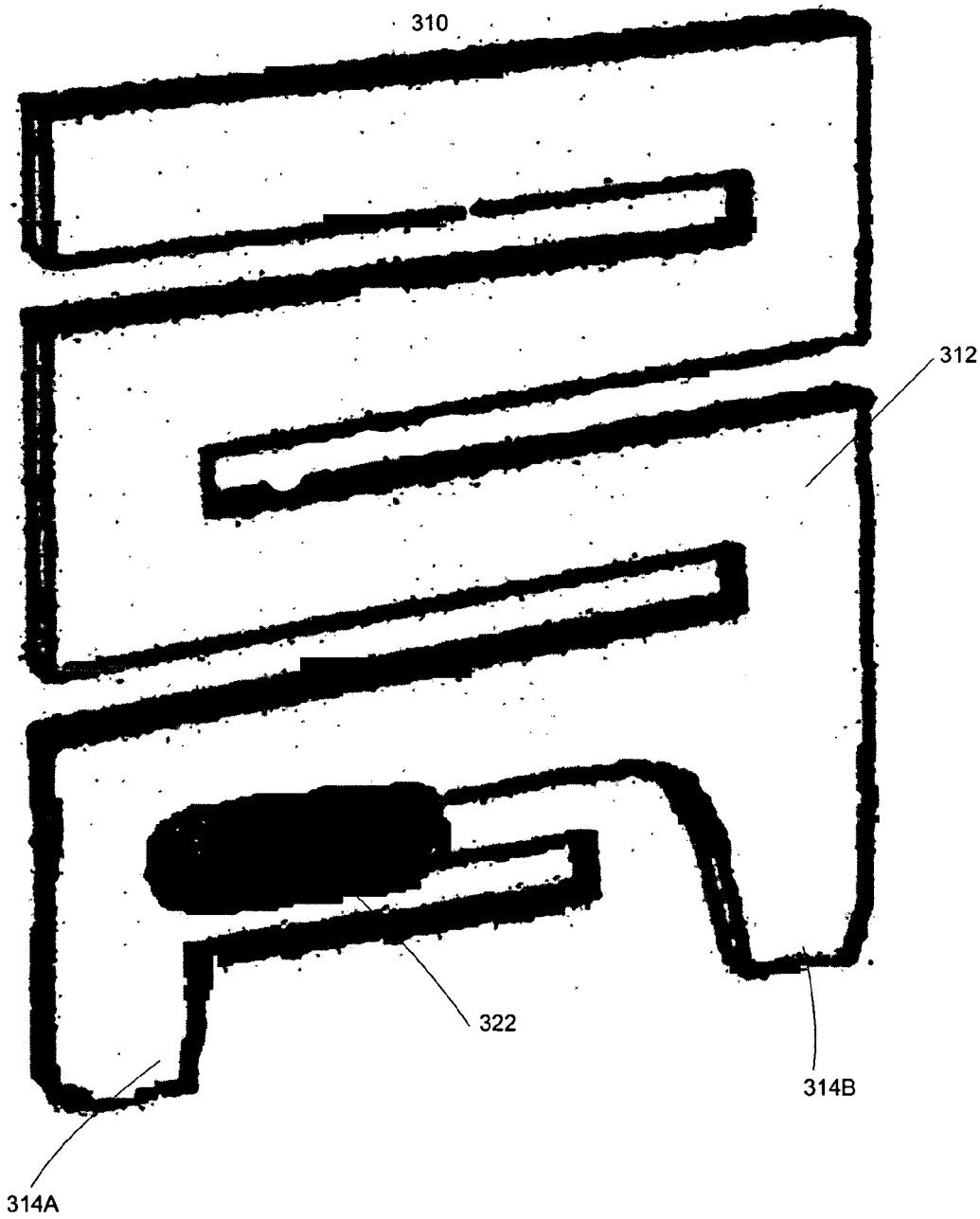
FIG. 3B is a front view of a second antenna in accordance with a third embodiment of the present invention.

FIGS. 3A and 3B illustrate a third embodiment of the present invention (hereinafter the "Meander with Conductive Compound Embodiment"). In FIG. 3A, a self-supporting antenna 310 in the form of a planar meander 312 is illustrated. Self-supporting antenna 310 is in all respects identical to self-supporting antenna 110 in the Meander Embodiment with one difference: self-supporting antenna 310 includes one additional element, conductive compound 318. Conductive compound 318 is attached to sections of planar meander 312 so as to short out a section of planar meander 312 and thereby decrease the antenna inductance.

In certain embodiments of the present invention, conductive compound 318 can be attached at different points along planar meander 312 so as to short out sections of the planar meander of differing length and thereby cause differing decreases in the antenna inductance. In this fashion, the antenna can be adjusted to meet the requirements of any particular device to which it is attached. Once the optimal placement of the conductive compound is determined with respect to a particular device through trial and error, it is then possible to mass produce antennas with the conductive compound added in a late step in the manufacturing process.

Optionally, instead of or in addition to the use of conductive compound 318 to tune self-supporting antenna 310, conductive compound 322 can be used to match the impedance output of the device to which self-supporting antenna 310 is attached, such as a radio or personal digital assistant, as illustrated in FIG. 3B. In FIG. 3B, conductive compound 322 is located near the feet of self-supporting antenna 310, creating a cross-link between feet 314A and 314B, and lowering the impedance output value of the antenna. By varying the amount, and placement of, conductive compound 322, the decrease in impedance output can be controlled, thereby controlling the antenna match. Due to differences in packaging and other variables from application to application, it is necessary to match an antenna to a particular application to ensure that the return loss will be minimal.

Conductive compounds 318 and 322 can be composed of a variety of substances. The same compound can be used for both conductive compound 318 and conductive compound 322 if both are present in the same embodiment of the present invention or different substances can be used for each. For example Cho-Bond 4660 product from the Chomerics division of the Parker Hannifin company of Woburn, Mass. (www.chomerics.com), which product includes a silver-plated copper filler and a polyisobutylene binder can be utilized, as can the Cho-Bond 5526 product from the same company, which product is another one-part silicone-based conductive compound using silver as its conductive loading. Both products provide satisfactory adhesive qualities and flexibility. Other compounds having adequate conductive properties that are capable of forming a lasting short circuit on the planar meander can be used instead.

Figure 4:
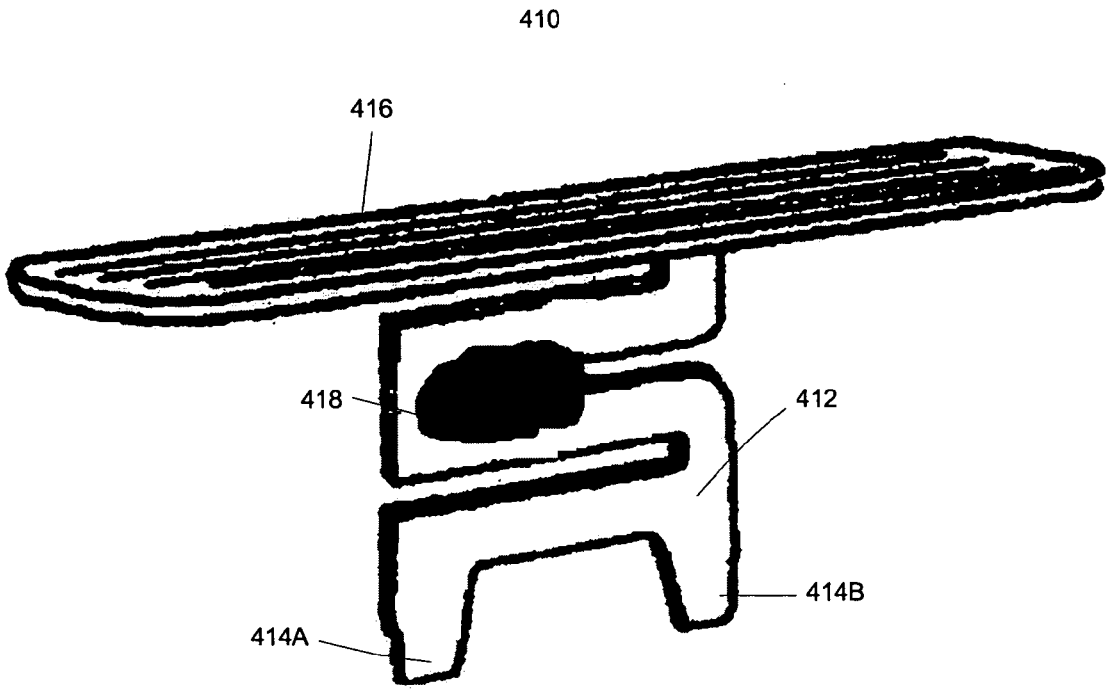
FIG. 4 is a view of an antenna in accordance with a fourth embodiment of the present invention.

FIG. 4 illustrates a fourth embodiment of the present invention (hereinafter the "Combination with Conductive Compound Embodiment"). A self-supporting antenna 410 in the form of a planar meander 412 attached to a secondary planar structure 416 is illustrated. Self-supporting antenna 410 is in all respects identical to self-supporting antenna 210 in the Combination Embodiment with one difference: self-supporting antenna 410 includes one additional element, conductive compound 418. Conductive compound 418 is attached to sections of planar meander 412 so as to short out a section of planar meander 412 and thereby decrease the antenna inductance.

In certain embodiments of the present invention, conductive compound 418 can be attached at different points along planar meander 412 so as to short out sections of the planar meander of differing length and thereby cause differing decreases in the antenna inductance. In this fashion, the antenna can be adjusted to meet the requirements of any particular device to which it is attached. Once the optimal placement of the conductive compound is determined with respect to a particular device through trial and error, it is then possible to mass produce antennas with the conductive compound added in a late step in the manufacturing process.

Optionally, instead of or in addition to the use of conductive compound 418 to tune self-supporting antenna 410, additional conductive compound can be used to match the impedance output of the device to which self-supporting antenna 410 is attached, such as a radio or personal digital assistant. By attaching additional conductive compound near the feet of self-supporting antenna 410, a cross-link can be created (similar to that described in connection with FIG. 3B above) between feet 414A and 414B, and lowering the impedance output value of the antenna. By varying the amount, and placement of, the additional conductive compound, the decrease in impedance output can be controlled, thereby controlling the antenna match. Due to differences in packaging and other variables from application to application, it is necessary to match an antenna to a particular application to ensure that the return loss will be minimal.

The conductive compound can be composed of a variety of substances. If conductive compound is used both for tuning and for match purposes in a specific embodiment of the present invention, the same or different substances can be used for each purpose. For example Cho-Bond 4660 product from the Chomerics division of the Parker Hannifin company of Woburn, Mass. (www.chomerics.com), which product includes a silver-plated copper filler and a polyisobutylene binder can be utilized, as can the Cho-Bond 5526 product from the same company, which product is another one-part silicone-based conductive compound using silver as its conductive loading. Both products provide satisfactory adhesive qualities and flexibility. Other compounds having adequate conductive properties that are capable of forming a lasting short circuit on the planar meander can be used instead.

Figure 5A:
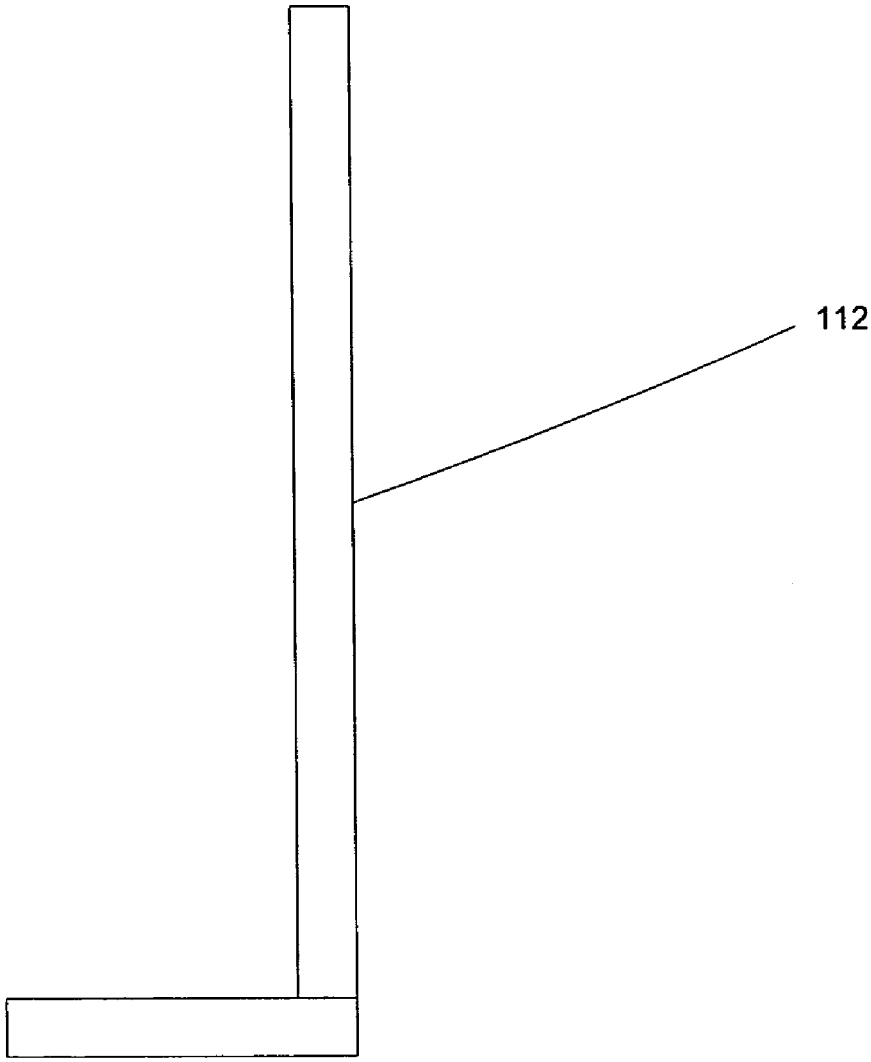
FIG. 5A illustrates an antenna in a standard fixed mount.
Figure 5B:
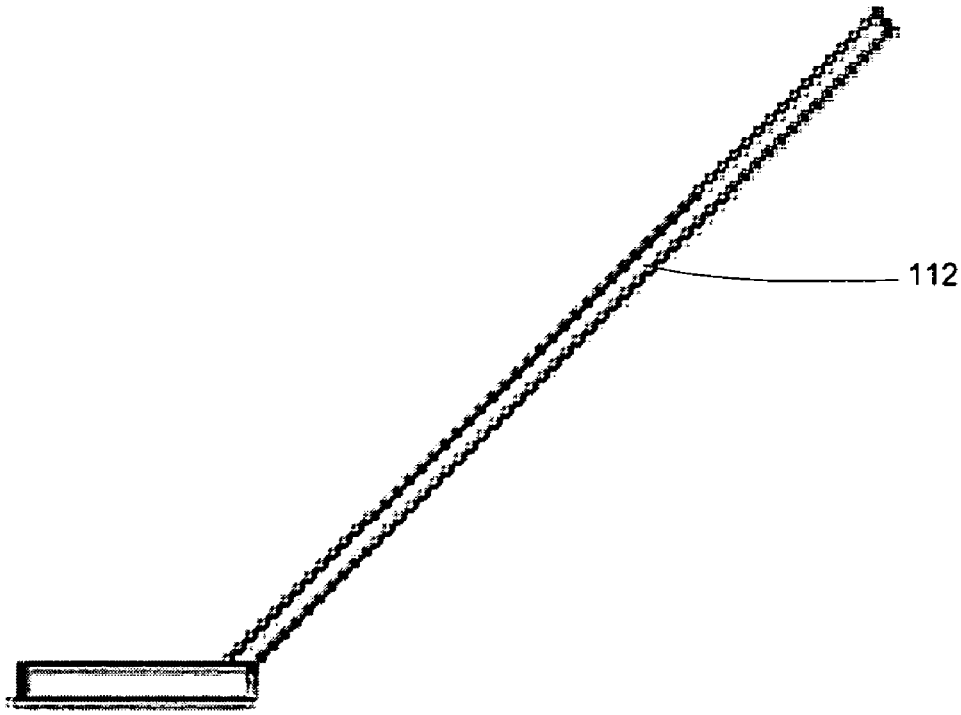
FIG. 5B illustrates a malleable antenna in accordance with an embodiment of the present invention.
Figure 5C:
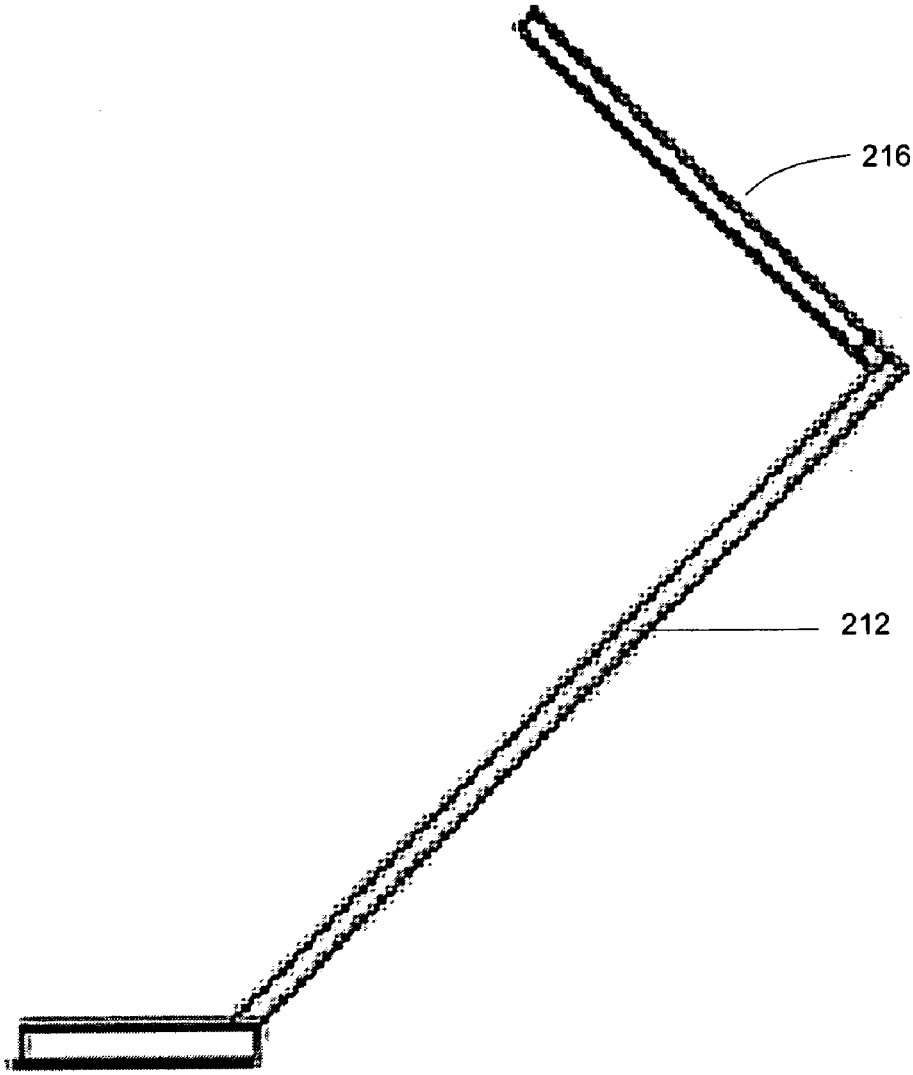
FIG. 5C illustrates a second malleable antenna in accordance with an embodiment of the present invention.

Referring to FIGS. 5A through 5C, certain additional advantages of certain embodiments of the present invention are illustrated. The antennas in accordance with these embodiments of the present invention generate a radiating pattern that is substantially isotropic, as measured in the horizontal domain. An advantage of substantial isotropic performance of these antennas is that substantially isotropic performance provides roughly equivalent signal strength regardless of the radio orientation with respect to the horizontal domain. This means that a mobile user will experience fewer annoying drop-offs in performance as radios incorporating the inventive antennas are moved about or communicated with.

Antennas in accordance with these embodiments are malleable, meaning that they are capable of being shaped, as by hammering or rolling. These metals can be plated to allow easy soldering. A further advantage of using malleable antennas in accordance with these embodiments of the present invention is that the antennas can be formed to multiple contours and will hold their shapes. This presents a way to control or modify the radio frequency field or pattern of an antenna, and allows the antenna shape to conform to a certain package design.

Antennas radiate energy, and that energy is controlled by R.F. ground structures, and other objects that are close to the radiating structure. These structures around the radiating element can misdirect the antenna pattern. Antennas in accordance with these embodiments can be shaped to allow the parts of the antenna structure to be moved with respect to surrounding parts or ground structures, to redirect the antenna pattern.

FIG. 5A illustrates a conventional antenna mounted in a mobile device, such as a personal digital assistant (hereinafter "pda"). When the pda is held at a forty-five degree angle, which most users find to be the most comfortable viewing angle for a pda, the antenna in FIG. 5A is no longer substantially vertically aligned. This causes substantial drop-offs in performance, with losses of as much as 6 db in typical pda applications. FIG. 5B illustrates a malleable antenna in accordance with an embodiment of the present invention that has been bent at an angle that causes the antenna to assume a substantially vertical position with respect to the ground when the pda is held at a forty-five degree angle. The result is that there is no drop-off in performance when the pda is held at a forty-five degree angle. FIG. 5C illustrates a malleable antenna in accordance with another embodiment of the present invention that has been bent at an angle that causes the antenna to assume a substantially vertical position with respect to the ground when the pda is held at a forty-five degree angle. This antenna also comprises a secondary planar structure attached to the primary planar structure. The secondary planar structure serves inter alia to provide additional gain to the antenna.

Figure 6A:
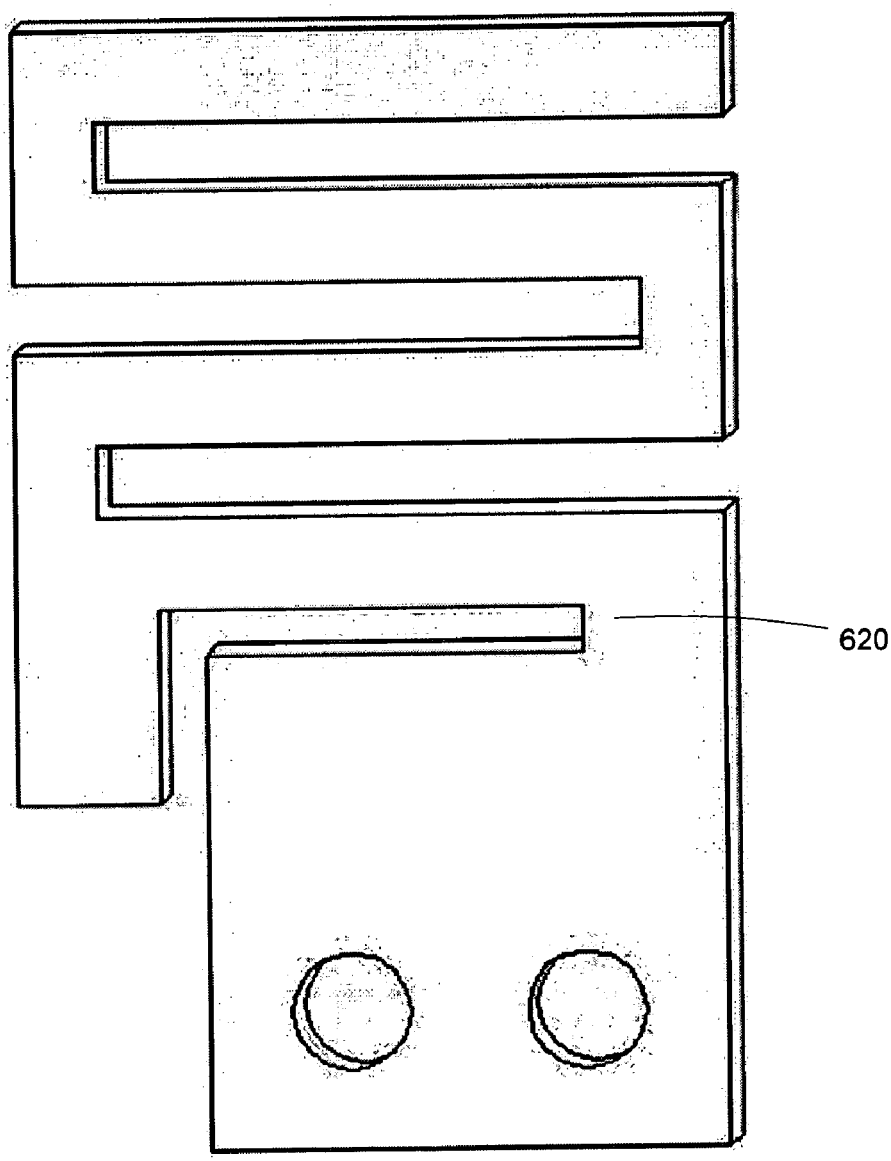
FIG. 6A illustrates an antenna and a first mounting for an antenna in accordance with certain embodiments of the present invention.
Figure 6B:
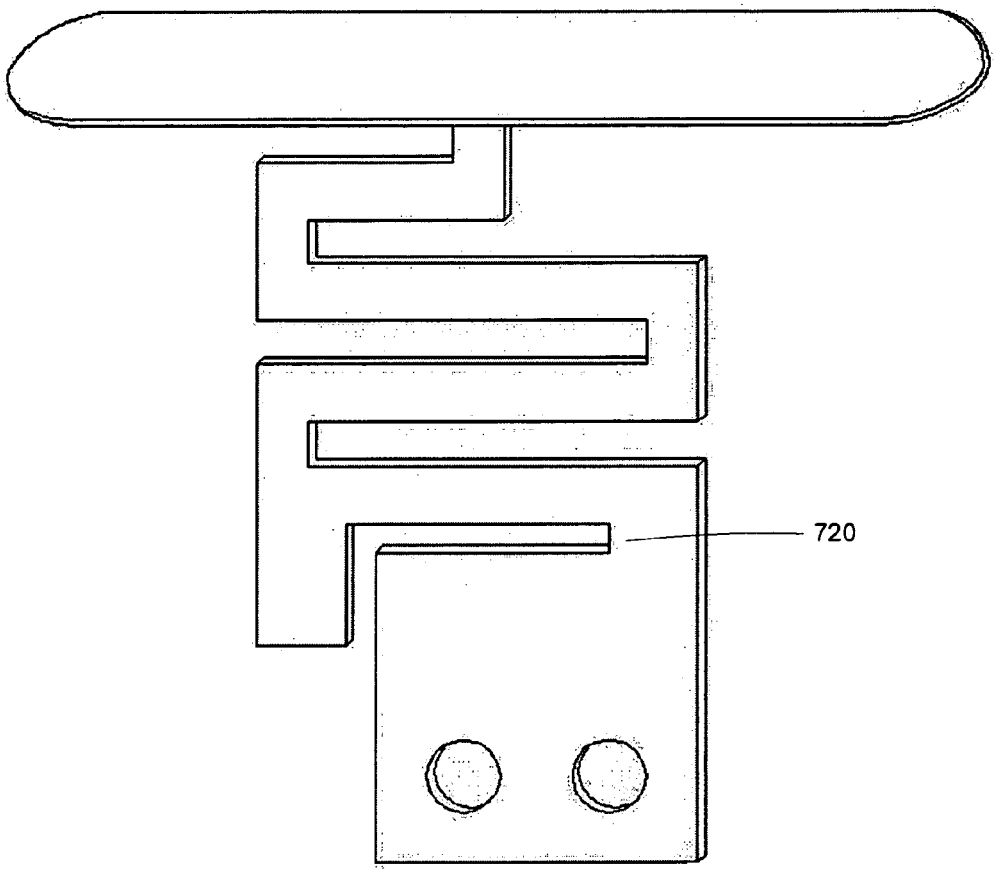
FIG. 6B illustrates an antenna and a second mounting for an antenna in accordance with certain embodiments of the present invention.
Figure 6C:
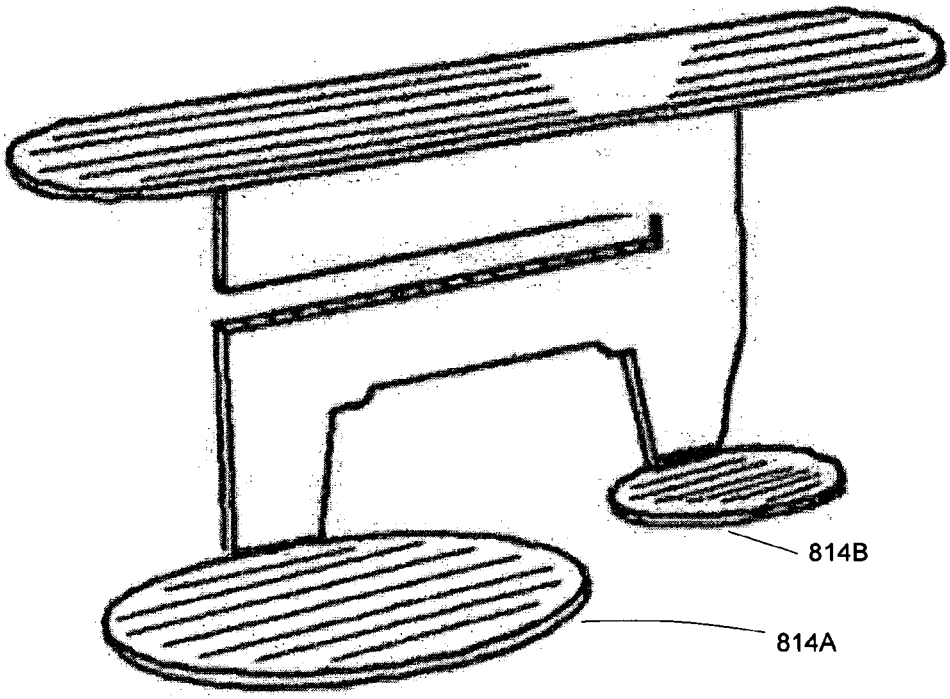
FIG. 6C illustrates an antenna and a third mounting for an antenna in accordance with certain embodiments of the present invention.

FIGS. 6A through 6C illustrate a variety of alternatives for mounting antennas in accordance with the present invention to P.C. boards or other surfaces. Referring to FIG. 6A, a mounting for an antenna in accordance with certain embodiments of the present invention capable of being mounted to a coaxial cable is illustrated. The coaxial cable can be attached at mounting point 620. Referring to FIG. 6B, a mounting for an antenna in accordance with certain additional embodiments of the present invention capable of being mounted to a coaxial cable is illustrated. The coaxial cable can be attached at mounting point 720. Referring to FIG. 6C, a mounting capable of being hand soldered to a P.C. board is illustrated. The feet of the antenna are attached to round pads 814A and 814B that are parallel to the P.C. board and perpendicular to the meander. Standard solder paste can be applied to the P.C. board and the pads can be soldered in place to mount the antenna in the desired position. Alternatively, an antenna in accordance with the present invention can be mounted to any P.C. board or ground plain using a screw or solder mounting.

Test data has validated the utility of antennas in accordance with the present invention. To evaluate the different antennas for gain, ground planes of 3.9 inches in diameter were machined to provide the same area of ground plane for each antenna tested. Relatively large ground planes were used because small ground planes tend to have a larger effect on pattern shape. If a larger ground plane shows any problem in pattern from an antenna, it will be from the antenna itself. Five antennas were mounted on the 3.9 inch ground planes and tuned for center frequency at 2.440 GHz. Antenna match was set for a minimum of −16 dB return loss; thus, reflection loss was low for each antenna (less than 2.5 percent loss). The antennas are listed below in gain order in the following chart:

| | Type | Height | Width | Gain |
|---|---|---|---|---|
| 1. | Quarter-wave isotropic (Reference antenna) | 1.175 | 0.2 | 0 dB |
| 2. | Large Combination Embodiment Antenna | 0.45 | 0.5 | +0.1 dB |
| 3. | Meander Embodiment Antenna | 0.60 | 0.5 | −0.1 dB |
| 4. | Small Combination Embodiment Antenna | 0.30 | 0.25 | −2.0 dB |
| 5. | Conventional Top Hat Antenna | 0.40 | 0.40 | −3.2 dB |

Type indicates type of antenna; height indicates height of the antenna in inches; width indicates width of the antenna meander in inches; and gain indicates gain difference versus the reference antenna under the above described conditions. While typical personal digital assistant and equivalent antennas were not tested in this sequence, prior tests indicate substantially poorer performance of such antennas under similar conditions.

The present invention may be embodied in other specific forms without departing from the spirit or essential attributes of the invention. Accordingly, reference should be made to the appended claims, rather than the foregoing specification, as indicating the scope of the invention.

The invention claimed is:

1. An antenna comprising a planar conductor, wherein said planar conductor is self-supporting;

wherein the radiating pattern of the antenna is substantially isotropic;

wherein the antenna further comprises a planar meander;

wherein said antenna further comprising dielectric material attached to said planar conductor; and wherein said dielectric material comprises a conductive polymer.

2. The antenna of claim 1, wherein said dielectric material shorts out a portion of said planar meander.

3. The antenna of claim 1, wherein said dielectric material forms a tuning device for the antenna.

4. The antenna of claim 1, wherein said dielectric material forms a device for matching impedance of the antenna to a device other than the antenna.

5. An antenna comprising a planar conductor, wherein said planar conductor is self-supporting;

wherein the radiating pattern of the antenna is substantially isotropic; and wherein the antenna further comprises integral electrostatic discharge protection.

6. The antenna of claim 5, wherein the antenna is vertically polarized.

7. An antenna comprising a planar conductor, wherein said planar conductor is self-supporting;

wherein the radiating pattern of the antenna is substantially isotropic;

wherein said antenna further comprises a secondary planar conductor attached to said planar conductor;

wherein said planar conductor comprises a planar meander; and wherein said secondary planar conductor comprises a planar obround structure.

8. The antenna of claim 7, wherein said planar conductor comprises a planar meander; and wherein said secondary planar conductor comprises a planar round structure.

9. An antenna comprising a planar conductor, wherein said planar conductor is self-supporting;

wherein the radiating pattern of the antenna is substantially isotropic; and wherein the antenna comprises a mounting capable of being hand soldered into a personal computer board.

10. An antenna comprising a planar conductor, wherein said planar conductor is self-supporting;

wherein the radiating pattern of the antenna is substantially isotropic; and wherein the antenna comprises a mounting capable of being screwed into a personal computer board.

11. An antenna comprising a planar conductor, wherein said planar conductor is self-supporting;

wherein the radiating pattern of the antenna is substantially isotropic;

wherein the antenna is no more than eight tenths of an inch (0.8") in height; and wherein the radio frequency performance of the antenna at 2.440 gigahertz (GHz) is within three decibels (3 db) of the radio frequency performance of a standard quarter wave isotropic antenna.

12. The antenna of claim 11, wherein the radio frequency performance of the antenna at 2.440 gigahertz (GHz) is within two decibels (2 db) of the radio frequency performance of a standard quarter wave isotropic antenna.

13. The antenna of claim 11, wherein the radio frequency performance of the antenna at 2.440 gigahertz (GHz) is within one decibel (1 db) of the radio frequency performance of a standard quarter wave isotropic antenna.

14. The antenna of claim 11, wherein the antenna is no more than one half of an inch (½") in height.

15. The antenna of claim 11, wherein the antenna comprises substantially no dielectric material.

16. The antenna of claim 11, wherein the antenna comprises no more than one percent (1%) dielectric material by weight.

17. The antenna of claim 11, wherein said planar conductor comprises at least one metal.

18. The antenna of claim 11, wherein the antenna comprises at least ninety-nine percent (99%) metal by weight.

19. The antenna of claim 11, wherein the antenna comprises at least ninety-five percent (95%) metal by weight.

20. The antenna of claim 11, wherein the antenna further comprises a planar meander.

21. The antenna of claim 20, further comprising dielectric material attached to said planar conductor.

22. The antenna of claim 11, further comprising a secondary planar conductor attached to said planar conductor.

23. The antenna of claim 11, wherein the antenna is mounted on a mobile device.

24. The antenna of claim 11, wherein said planar conductor is malleable.

25. The antenna of claim 11, wherein said planar conductor forms a partially open cylindrical shape.

* * * * *